US005556827A

United States Patent [19]

Nogiwa et al.

[11] Patent Number: 5,556,827

[45] Date of Patent: *Sep. 17, 1996

[54] METHOD FOR PRODUCING REVERSIBLE THERMOSENSITIVE RECORDING MATERIAL

[75] Inventors: Toru Nogiwa, Numazu; Yukio Konagaya, Shimizu-machi; Yoshihiko Hotta, Mishima; Kunichika Morohoshi, Numazu; Makoto Kawaguchi, Shizuoka-ken; Akira Suzuki; Fumihito Masubuchi, both of Mishima; Tsutomu Kagawa, Shizuoka-ken, all of Japan

[73] Assignee: Ricoh Company, Ltd., Tokyo, Japan

[ * ] Notice: The term of this patent shall not extend beyond the expiration date of Pat. No. 5,380,550.

[21] Appl. No.: 199,797

[22] Filed: Feb. 22, 1994

Related U.S. Application Data

[63] Continuation-in-part of Ser. No. 910,509, Jul. 8, 1992, abandoned.

[30] Foreign Application Priority Data

Jul. 8, 1991 [JP] Japan ..... 3-193421
Jul. 3, 1992 [JP] Japan ..... 4-200368

[51] Int. Cl.[6] ..... B41M 5/36

[52] U.S. Cl. ..... 503/201; 428/195; 428/913; 428/914; 427/146; 427/366; 427/372.2; 427/385.5

[58] Field of Search ..... 503/204, 201; 427/146, 148, 372.2, 384, 385.5, 388.4, 388.5, 150, 152, 366; 428/195, 913, 914

[56] References Cited

U.S. PATENT DOCUMENTS

| | | | |
|---|---|---|---|
| 4,917,948 | 4/1990 | Hotta . | |
| 5,017,421 | 5/1991 | Hotta et al. . | |
| 5,085,934 | 2/1992 | Hotta et al. . | |
| 5,087,601 | 2/1992 | Hotta et al. . | |
| 5,158,924 | 10/1992 | Konagaya et al. . | |
| 5,158,926 | 10/1992 | Hotta et al. . | |
| 5,219,820 | 6/1993 | Morohoshi et al. . | |
| 5,260,254 | 11/1993 | Hotta et al. . | |
| 5,283,220 | 2/1994 | Kawaguchi et al. . | |
| 5,380,550 | 1/1995 | Sugiyama et al. | 427/146 |

*Primary Examiner*—Pamela R. Schwartz
*Attorney, Agent, or Firm*—Oblon, Spivak, McClelland, Maier, & Neustadt, P.C.

[57] ABSTRACT

A method of producing a reversible thermosensitive recording material composed of a support, and a reversible thermosensitive recording layer formed thereon, which contains a matrix resin and an organic low-molecular weight material dispersed in the matrix resin, and capable of reversibly assuming a transparent state and a white opaque state depending upon the temperature thereof, is composed of the steps of applying a solution or dispersion of the matrix resin and the organic low-molecular-weight material dissolved or dispersed in a solvent to the support, and drying the applied solution or dispersion with the application of heat thereto in such a manner that when the temperature of the solution or dispersion applied side of the support it $t_1$, and the temperature of the back side surface of the support, opposite to the solution or dispersion applied side thereof, is $t_2$, $t_1$ is lower than $t_2$ ($t_1<t_2$), with the back side surface of the support being heated immediately after the coating of the solution or dispersion.

3 Claims, 6 Drawing Sheets

$t_1 < t_2$ (1)

(2)

(3)

(4)

(1)

(2)

(3)

(4)

METHOD FOR PRODUCING REVERSIBLE THERMOSENSITIVE RECORDING MATERIAL

This application is a continuation-in-part of application Ser. No. 07/910,509, filed Jul. 8, 1992 now abandoned.

BACKGROUND OF THE INVENTION

1. Field of the Invention

The present invention relates to a method for producing a reversible thermosensitive recording material which comprises a support and a reversible thermosensitive recording layer formed thereon, which is capable of developing and erasing images repeatedly by utilizing the property of reversibly changing the transparency of the reversible thermosensitive recording layer, depending upon the temperature thereof.

2. Discussion of Background

In recent years, some attention is paid to a reversible thermosensitive recording material capable of temporarily recording images thereon and erasing the same therefrom when such images become unnecessary. As a representative example of that kind of reversible thermosensitive recording material, there is conventionally known a reversible thermosensitive recording material comprising a support and a reversible thermosensitive recording material formed thereon, in which an organic low-molecular-weight material such as a higher fatty acid is dispersed in a matrix resin such as vinyl chloride—vinyl acetate copolymer with a glass transition temperature (Tg) in the range of 50° C. to less than 80° C., as disclosed in Japanese Laid-Open Patent Applications 54-119377 and 55-154198.

When such a conventional reversible thermosensitive recording material is manufactured, an organic solvent such as tetrahydrofuran is employed as a base solvent which dissolves or disperses both the matrix resin and the organic low-molecular-weight material for the reversible thermosensitive recording layer. Organic solvents of this kind have extremely low boiling points and high evaporation rates, so that they soon evaporate from a coating liquid applied to a support for the formation of a reversible thermosensitive recording layer thereon even before the applied coating liquid is dried. As a result, a thin film of the matrix resin is formed on the surface of the recording layer. Due to the formation of the thin film of the matrix resin on the surface of the recording layer, not only the evaporation of the solvent within the recording layer is prevented, but also the particle diameter of the organic low-molecular-weight material dispersed in the matrix resin increases, and the organic low-molecular-weight material separates out on the surface of the recording layer with time.

Moreover, there is the disadvantage that the contact between the support and the thermosensitive recording layer at the interface thereof becomes poor because of the solvent remaining in the thermosensitive recording layer. In addition to the above disadvantage, because of the presence of the residual solvent in the thermosensitive recording layer, there is a problem in that another layer cannot be smoothly overlaid on the surface of the recording layer. In the case where the formation of images and the erasure thereof are repeated many times with the simultaneous application of pressure and heat to the recording material, for instance, by a thermal head, small particles of the low-molecular-weight material gradually grow into large particles, so that the low-molecular-weight material loses the function of scattering light. As a result, the degree of whiteness of the reversible thermosensitive recording layer is eventually decreased and finally the contrast of images is lowered. Furthermore, since the particles of the organic low-molecular-weight material separate out on the surface of the reversible thermosensitive recording layer, even when a protective layer is overlaid on the reversible thermosensitive recording layer, the small particles of the organic low-molecular-weight material in the recording layer migrate to the protective layer and adhere in the form of a dust to a thermal head. The result is that the image formation and the erasure cannot be repeated many times with such a conventional reversible thermosensitive recording material.

SUMMARY OF THE INVENTION

It is therefore an object of the present invention to provide a method of producing a reversible thermosensitive recording material which is free from the above-mentioned conventional shortcomings, and capable of yielding uniform images even when the image formation and the erasure are repeatedly performed by applying heat and pressure to the reversible thermosensitive recording material at the same time by using a thermal head, without causing any dust adhesion to the thermal head.

The object of the present invention is achieved by a method of producing a reversible thermosensitive recording material comprising a support, and a reversible thermosensitive recording layer formed thereon, which comprises a matrix resin and an organic low-molecular weight material dispersed in the matrix resin, comprising the steps of (a) applying a solution or dispersion of the matrix resin and the organic low-molecular weight material dissolved or dispersed in a solvent to the support, and (b) drying the applied solution or dispersion with the application of heat thereto in such a manner that the temperature of the solution or dispersion applied side of the support Is lower than the temperature of the back side surface of the support, which is opposite to the solution or dispersion applied thereto.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 2(*b*) is a diagram of the schematic partial cross-sectional views of a reversible thermosensitive recording layer prepared by a conventional method, showing the formation of the particles of the organic low-molecular-weight material in the thermosensitive recording layer by applying and drying a solution or dispersion of the organic low-molecular-weight material to a support, with the temperature of the solution or dispersion applied side of the support being higher than the temperature of the back side surface of the support;

FIG. 3(*b*) is the temperature profile of a support when drying the applied solution or dispersion of the organic low-molecular-weight material by a conventional method;

DETAILED DESCRIPTION OF THE PREFERRED EMBODIMENTS

Figure 1:
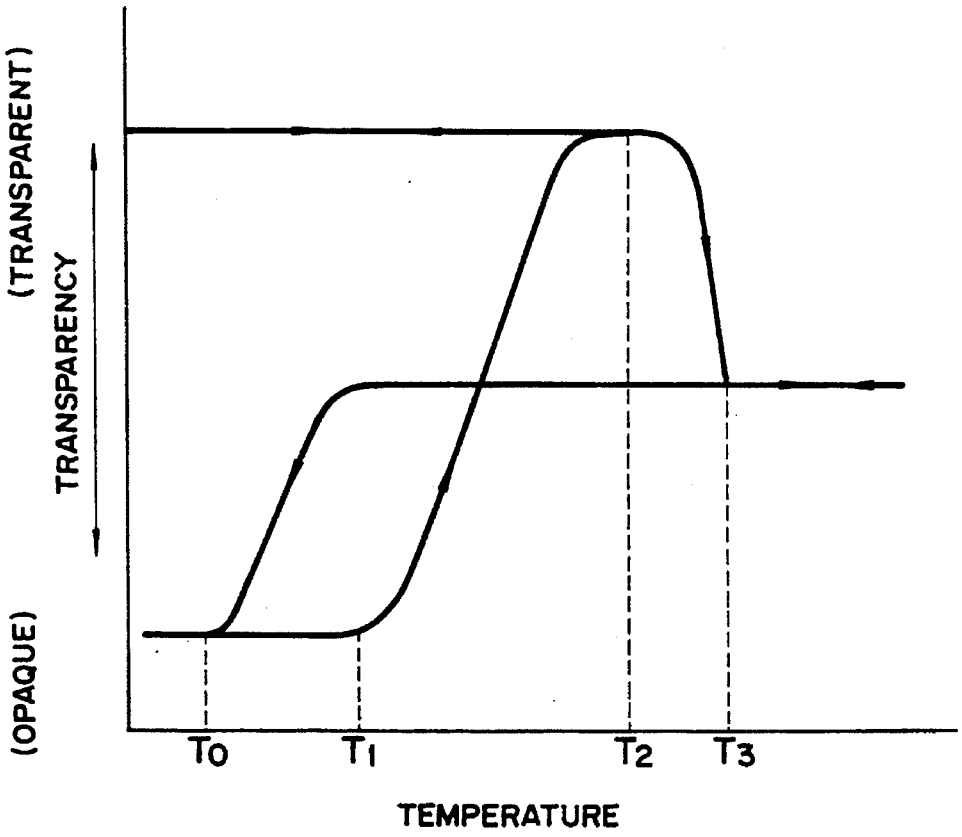
FIG. 1 is a diagram in explanation of the principle of the formation and erasure of images in a reversible thermosensitive recording material prepared by the present invention.
Figure 2A:
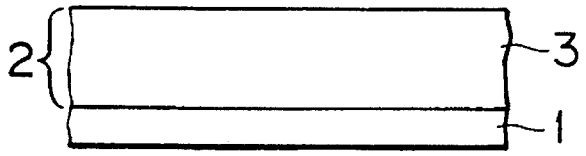
FIG. 2(*a*) is a diagram of the schematic partial cross-sectional views of a reversible thermosensitive recording layer prepared by the method of the present invention, showing the formation of the particles of an organic low-molecular-weight material in the thermosensitive recording layer prepared by applying and drying a solution or dispersion of the organic low-molecular-weight material to a support, with the temperature of the solution or dispersion-applied side of the support maintaining lower than the temperature of the back side surface of the support.
Figure 2A:
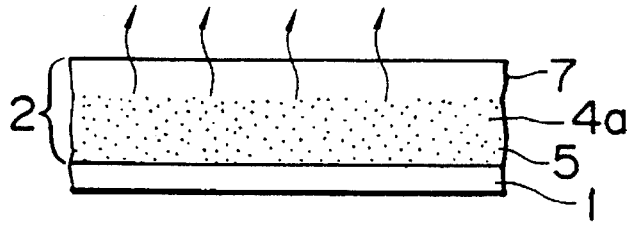
Figure 2A:
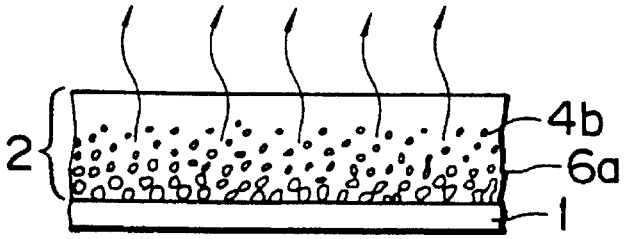
Figure 2A:
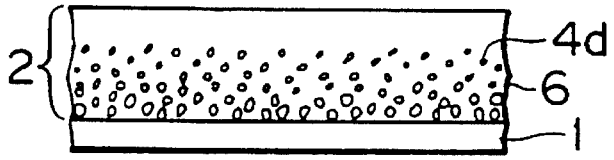
Figure 2B:
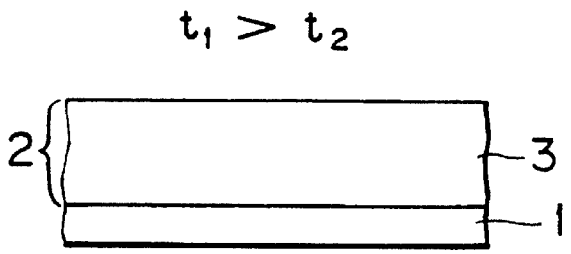
FIG. 2(b) PRIOR ART
Figure 2B:
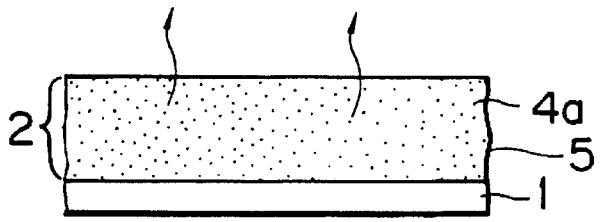
FIG. 2(b) PRIOR ART
Figure 2B:
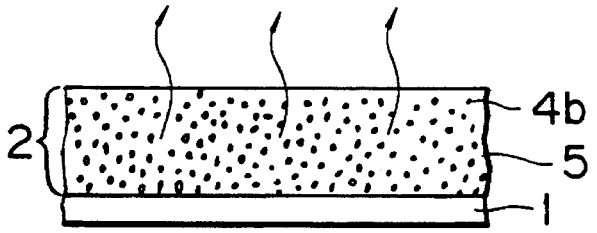
FIG. 2(b) PRIOR ART
Figure 2B:
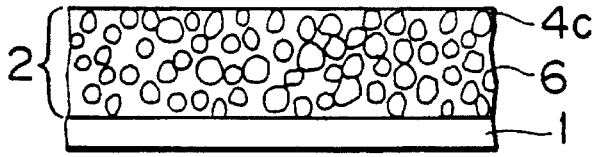
FIG. 2(b) PRIOR ART

In the method of producing a reversible thermosensitive recording material comprising a support, and a reversible thermosensitive recording layer formed thereon, which comprises a matrix resin and an organic low-molecular-weight material dispersed in the matrix resin according to the present invention, a solution or dispersion of the matrix resin and the organic low-molecular weight material dissolved or dispersed in a solvent is applied to the support, and the applied solution or dispersion is dried with the application of heat thereto in such a manner that the temperature ($t_1$) of the solution or dispersion applied side of the support is lower than the temperature ($t_2$) of the back side surface of the support, that is $t_1<t_2$. More specifically, in the present invention, the back side surface of the support is heated immediately after the application of the solution or dispersion to the support, by use of a heat-roll drying apparatus, a hot air drying apparatus, and a heat-plate drying apparatus.

In the reversible thermosensitive recording material according to the present invention, which comprises the reversible thermosensitive recording layer capable of reversibly changing the transparency from a transparent state to an opaque state, and vice versa, depending upon the temperature thereof, it is important that the particle size distribution of the organic low-molecular-weight material has a gradient in such a fashion that the particle diameter of the organic low-molecular-weight material be increased in the direction from the surface of the reversible thermosensitive recording layer toward the support side.

More specifically, in such a reversible thermosensitive recording material, the portion of the reversible thermosensitive recording layer near the support is not easily affected by the heat and pressure of a thermal head, so that even when the particle diameter of the organic low-molecular-weight material is relatively large, and heat and pressure are applied thereto by the thermal head, the particle diameter of the organic low-molecular-weight material is not changed. As a result, the same uniform image formation as the initial image formation can be attained. On the other hand, the portion of the reversible thermosensitive recording layer near the surface thereof is directly affected by the heat and pressure of a thermal head, but the particle size of the organic low-molecular-weight material in that portion is small and the organic low-molecular-weight material is thickly covered with the matrix resin, the organic low-molecular-weight material can be maintained in the form of finely-divided particles even when the application of heat and pressure by the thermal head is repeated a number of times. Therefore, the image contrast is not decreased at all. Furthermore, since the particles of the organic low-molecular-weight material in the surface portion of the reversible thermosensitive recording layer are covered with the matrix resin, no migration of the particles of the organic low-molecular-weight material takes place. Therefore, no dust adheres to the thermal head even though the recording and erasing operations are repeated by use of a thermal head, so that uniform image formation can be attained.

It is preferable that the average particle diameter of the organic low-molecular-weight material near the support be in the range of 0.1 to 5.0 μm, more preferably in the range of 0.3 to 3.0 μm.

In the case where the particle diameter of the organic low-molecular-weight material near the support is less than 0.1 μm, since the particles of the organic low-molecular-weight material are substantially covered with the matrix resin, there is the tendency that the transparency of the recording layer cannot be sufficiently changed reversibly between a transparent state and an opaque state when the amount of thermal energy applied by a thermal head is small, so that the image contrast is degraded.

When the particle diameter of the organic low-molecular-weight material near the support of the thermosensitive recording layer exceeds 5.0 μm, the effect of scattering light is reduced and accordingly the image contrast is decreased.

It is preferable that the average particle diameter of the organic low-molecular-weight material near the surface of the reversible thermosensitive recording layer be in the range of 0.05 to 1.0 μm, more preferably in the range of 0.1 to 0.8 μm.

When the particle diameter of the organic low-molecular-weight material near the surface of the reversible thermosensitive recording layer is less than 0.05 μm, there is the tendency that it is difficult for the organic low-molecular-weight material to assume a polycrystalline state in the matrix resin, and the degree of whiteness of the reversible thermosensitive recording layer is degraded. As a result, the image contrast is lowered.

In the case where the particle diameter of the organic low-molecular-weight material near the surface of the thermosensitive recording layer is more than 1.0 μm, the particles grow and separate out on the surface of the thermosensitive recording layer, causing the problem of dust adhesion to the thermal head, because the particles of the organic low-molecular-weight material are not sufficiently covered with the matrix resin.

The above-mentioned gradient of the particle size distribution of the low-molecular-weight material in such fashion that the particle size thereof increases in the direction from the surface of the reversible thermosensitive recording layer toward the support can be attained by the previously mentioned method of the present invention.

The low-molecular-weight material near the support which has a particle diameter in the range of 0.1 to 5.0 μm, and with the particle diameter being near the surface of the thermosensitive recording layer which has a particle diameter in the range of 0.05 to 1.0 μm can be obtained by the method for producing the reversible thermosensitive recording material of the present invention. It is preferable that the temperature of the applied heat to the support be in the range of 50° C. to 140° C., more preferably in the range of 70° C. to 120° C. under such conditions that the temperature of the solution or dispersion applied side of the support is maintained lower than the temperature of the back side surface of the support.

When the temperature of the heat applied to the support is less than 50° C., the particle size of the low-molecular-weight material increases and the particles thereof separate out on the surface of the thermosensitive recording layer, so that the dust adheres to the thermal head, and the durability of the reversible thermosensitive recording material deteriorates. On the other hand, when the temperature of the heat applied to the support is more than 140° C., there is the problem in that the support for use in the reversible thermosensitive recording material is stretched and deformed by the applied heat.

In the present invention, as mentioned above, when the solution or dispersion of the organic low-molecular weight material is applied to the support and dried, the temperature of the solution or dispersion applied side of the support is lower than the temperature of the back side surface of the support, opposite to the solution or dispersion applied side thereof. When such a heating and drying process is employed, the above gradient of the particle size distribution of the organic low-molecular weight material can be obtained in the reversible thermosensitive recording layer. However, the reason why such a particle size distribution gradient can be obtained is not clear, but it is considered that when the above heating and drying process is employed, the evaporation rate and diffusion rate of the solvent are appropriately adjusted in such a manner that the particles of the organic low-molecular-weight material grow into larger particles near the support than near the surface of the reversible thermosensitive recording layer, without forming a than film layer of the matrix resin on the surface of the reversible thermosensitive recording layer upon heating the coated reversible thermosensitive recording layer.

In the above heating and drying process, the back side of the support is heated immediately after the application of the solution or dispersion.

With reference to FIG. 2(*b*), a conventional heating and drying process for the formation of the reversible thermosensitive recording layer will now be explained. In the conventional heating and drying process, since hot air is blown against the surface of the coated reversible thermosensitive recording layer, the temperature ($t_1$) of the surface of the coated reversible thermosensitive recording layer is higher than the temperature ($t_2$) of the back side of the support, that is, $t_1>t_2$. Therefore, the solvent contained in the coated reversible thermosensitive recording layer coating liquid evaporates quickly immediately after the application of the coating liquid, so that a thin film layer (not shown) containing the matrix resin and the organic low-molecular weight material is formed at the surface of the coated reversible thermosensitive recording layer, and most of the solvent remains inside the coated reversible thermosensitive recording layer. During the heating and drying process, the particles of the organic low-molecular weight material grow by the effect of the remaining solvent and eventually large particles 4*c* of the organic low-molecular weight material are formed as illustrated in Step (4) in FIG. 2(*b*). In the figure, reference numeral 1 indicates a support; reference numeral 2, a reversible thermosensitive recording layer formed on the support 1. Reference numeral 3 in Step (1) in FIG. 2(*b*) indicates the applied coating liquid for formation of the reversible thermosensitive recording layer 2. In the course of the heating and drying process, the solvent 5 evaporates as shown by the upward-directing arrows and particles 4*a* of the organic low-molecular weight material are formed in Step (2) shown in FIG. 2(*b*). In Step (3), the particles 4*a* grow into particles 4*b* and the solvent 5 still remains in the reversible thermosensitive recording layer 2. In Step (4), the particles 4*b* of the organic low-molecular-weight material further grow into larger particles 4*c* and the matrix resin 6 is completely fixed to the support 1, with complete evaporation of the solvent 5.

In contrast with the above, when the temperature ($t_1$) of the surface of the coated reversible thermosensitive recording layer is lower than the temperature ($t_2$) of the back side of the support, that is, $t_1<t_2$, during the heating and drying process, as illustrated in FIG. 2(*a*), according to the present invention, the drying of the coating liquid begins near the support 1 in Step (1) in FIG. 2(*a*). By the evaporation of the solvent from the surface of the coated reversible thermosensitive recording layer, and by the drying of the matrix resin, the organic low-molecular weight material is held by the matrix resin, and the growing of the particles of the organic low-molecular weight material near the support proceeds, while the growing of the particles of the organic low-molecular-weight material near the surface of the coated reversible thermosensitive recording layer is relatively hindered to form small particles of the organic low-molecular weight material. As a result, the gradient of the particle size distribution of the organic low-molecular weight material as illustrated in FIG. 2(*a*) is formed. In the figure, reference numeral 4*d* indicates the particles of the organic low-molecular resin, whose growth has been stopped; reference numeral 6*a*, the matrix resin fixed to the support reference numeral 7 indicates a thin film layer of the matrix resin formed in Step (2) in FIG. 2(*a*), and the other reference numerals are the same as in FIG. 2(*b*).

Figure 3A:
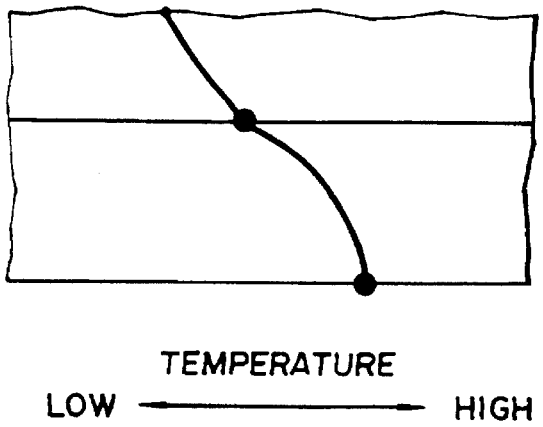
FIG. 3(*a*) is the temperature profile of a support when drying the applied solution or dispersion of the organic low-molecular-weight material by the method of the present invention.
Figure 3B:
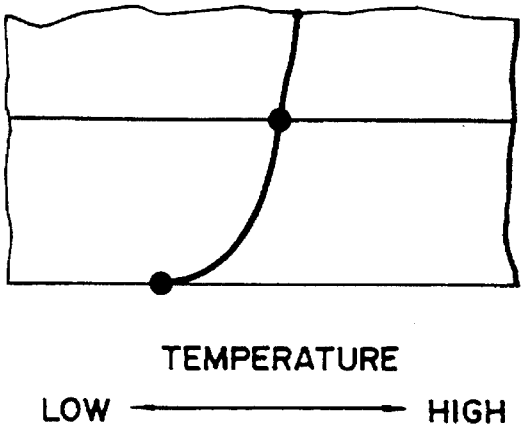

FIG. 3(*a*) is a diagram indicating the temperature profile of the support during the heating and drying process in the present invention, and FIG. 3(*b*) is a diagram indicating the temperature profile of the support during the conventional heating and drying process. These profiles were obtained by the thermo-couples which were attached to both sides of each support, using a data processing based on a finite-element method. The temperature curve shown within each support was estimated.

As mentioned previously, a key feature of the present invention is the production of a recording layer having a particle size distribution of the organic low-molecular weight material having a gradient such that the particle diameter of the organic low-molecular-weight material increases from the surface of the layer down to the support side of the layer.

In an attempt to attain this, even when the back side of the support is heated prior to the application of the solution or dispersion of the matrix resin and the organic low-molecular weight material, the support is cooled prior to the application of the solution or dispersion because of the heat of evaporation of the solvent contained in the solution or dispersion, so that a recording layer having a particle size distribution of the organic low-molecular weight material with the above-mentioned gradient for use in the present invention cannot be obtained.

Figure 4:
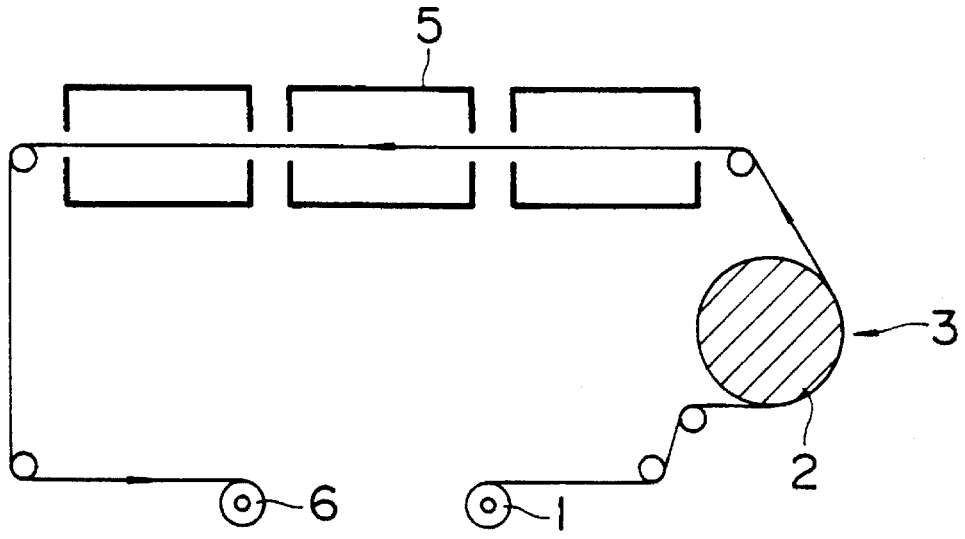
FIG. 4 is a diagram of a heat-roll drying system in which the back side surface of a support is heated simultaneously with the application of the solution or dispersion to the support by use of a heat-back-roller drying apparatus for use in a comparative test.

Furthermore, when the back side of the support is heated simultaneously with the application of the solution or dispersion by heat rollers as shown in FIG. 4, the above-mentioned problem does not occur before several tens meters of coating. However, when the coating length exceeds more than several tens meters, the temperature of the solution or dispersion in the coater 3 as shown in FIG. 4 is gradually increased, and when the temperature of the solution or dispersion is increased, the following problems occur:

(1) Because the temperature of the solution or dispersion is so high that immediately after the solution or dispersion is ejected from the outlet of the coater 3, an organic solvent with a low boiling point contained in the solution or dispersion, such as tetrahydrofuran, is evaporated, and as a matter of course, the properties of the solution or dispersion, such as the viscosity and the content ratio of solid components in the solution or dispersion, are immediately changed. The result is that the thickness of the coated reversible thermosensitive layer becomes uneven.

(2) When the solution or dispersion which has been heated within the coater 3 is ejected therefrom, and heated again by the heat rollers through the support, the solution or dispersion is instantly boiled in contact with the surface of the support, so that uniform coating of the solution or dispersion becomes difficult.

(3) When the temperature of the solution or dispersion is increased, the solvent contained in the coated recording layer is evaporated from the surface providing a thin film layer on the surface of the recording layer. This effectively traps solvent inside the coated reversible thermosensitive recording layer which enables the particles of the organic low-molecular weight material to grow during the remainder of the heating and drying process. Furthermore, the grown organic low-molecular weight material tends to separate out on the surface of the reversible thermosensitive recording layer. This significantly degrades the quality and mechanical durability of the recording layer, so that a large quantity of dust is formed during recording by a thermal head.

Thus, in the present invention, it is essential that the back side surface of the support be heated immediately after the application of the solution or dispersion of the matrix resin and organic low-molecular weight material for providing a reversible thermosensitive recording layer on the support.

Examples of the heating and drying apparatus for the present invention are a heat-roll drying apparatus, a hot air drying apparatus, a heat-plate drying apparatus and a heat-back-roll drying apparatus. Of these, the heat-roll drying apparatus and the heat-plate drying apparatus are most effective for heating and drying the coated reversible thermosensitive recording layer since the support is heated by direct contact with these apparatus.

The heating effect of the hot air drying apparatus can be improved by reducing the gap between the support and the hot outlet of the apparatus.

Examples of the system using the heat-roll drying apparatus for use in the present invention are steam heating, infrared heating, electromagnetic heating, and dielectric heating systems. Examples of the system using the hot air drying apparatus for use in the present invention are steam heating, infrared heating, and electromagnetic heating systems. In addition, examples of the system using the heat-plate drying apparatus for use in the present invention are steam heating, infrared heating, and electromagnetic heating systems.

With reference to FIG. 4 to FIG. 7, heating and drying systems for use in the present invention will now be explained.

Figure 5:
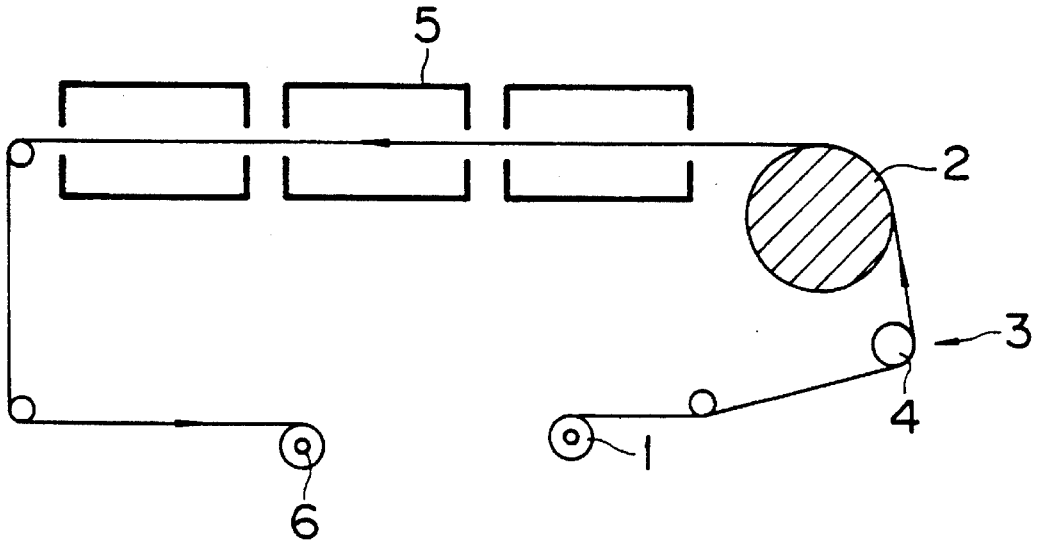
FIG. 5 is a diagram of an after-heat drying system in which the back side surface of the support is heated immediately after the application of the solution or dispersion to the support by use of a heat-roll drying apparatus for use in the present invention.

FIG. 4 and FIG. 5 illustrate heat-roll drying systems. In the heat-roll drying system shown in FIG. 4, a support fed from an unwinder 1 is transported onto a heat-back-roller 2, at which the support is coated with a solution or dispersion of the matrix resin and the organic low-molecular weight material dissolved or dispersed in a solvent by a coater 3, and at the same time, the coated layer is heated by the heat back roller 2 as shown in FIG. 4.

FIG. 5 shows an after-heat drying system, in which the support fed from the unwinder 1 is transported onto a roller 4, at which the support is coated with the solution or dispersion of the matrix resin and the organic low-molecular weight material by the coater 3, and the coated layer is then heated by the heat-back-roller 2.

Figure 6:
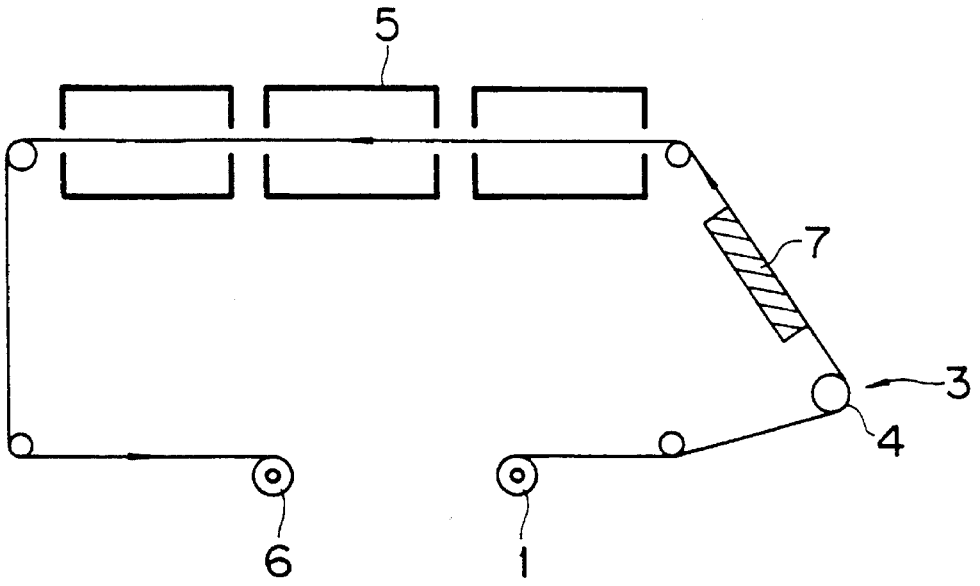
FIG. 6 is a diagram of a heat-plate drying system in which the back side surface of the support is heated immediately after the application of the solution or dispersion to the support by use of a heat-plate drying apparatus for use in the present invention.

FIG. 6 shows a heat plate drying system, in which the heat-back-roller 2 in the after-heat drying system shown in FIG. 5 is replaced by a plate heater 7.

Figure 7:
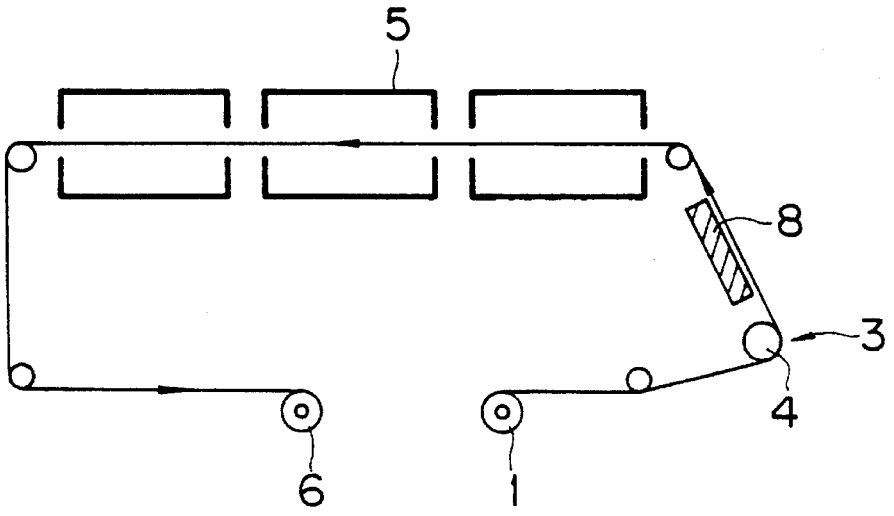
FIG. 7 is a diagram of a hot air drying system in which the back side surface of the support being heated immediately after the application of the solution or dispersion to the support by use of a hot air drying device for use in the present invention.

FIG. 7 shows a hot air drying system, in which the plate heater 7 employed in the heat plate drying system shown in FIG. 6 is replaced by a hot-air-drying device 8.

After the coated layer is heated by any of the above systems, the reversible thermosensitive recording material composed of the support and the reversible thermosensitive recording layer formed thereon is caused to pass through an anneal boxes 5 and is then wound around a winder 6.

The reversible thermosensitive recording material of the present invention can be switched from a transparent state to a milky white opaque state, and vice versa, depending on the temperature thereof. It is presumed that the difference between the transparent state and the milky white opaque state of the recording material is based on the following principle:

(i) In the transparent state, the organic low-molecular-weight material dispersed in the matrix resin consists of relatively large crystals, so that the light which enters the crystals from one side passes therethrough to the opposite side, without being scattered, thus the reversible thermosensitive recording material appears transparent.

(ii) In the milky white opaque state, the organic low-molecular-weight material is composed of polycrystals consisting of numerous small crystals, with the crystallographic axes pointed to various directions, so that the light which enters the recording layer is scattered a number of times on the interface of crystals of the low-molecular-weight material. As a result, the thermosensitive recording layer becomes opaque in a milky white color.

The transition of the state of the reversible thermosensitive recording layer depending on the temperature thereof will now be explained by referring to FIG. 1.

In FIG. 1, it is supposed that the reversible thermosensitive recording material comprising a matrix resin and a low-molecular-weight material dispersed in the matrix resin is initially in a milky white opaque state at room temperature $T_0$ or below. When the recording material is heated to temperature $T_2$, the recording material becomes transparent. Thus, the recording material reaches a maximum transparent state at temperature $T_2$. Even if the recording material which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording material in the maximum transparent state is further heated to temperature $T_3$ or more, it assumes a medium state which is between the maximum transparent state and the maximum milky white opaque state. When the recording material in the medium state at temperature $T_3$ is cooled to room temperature $T_0$ or below, the recording material returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording material in the milky white opaque state is heated to any temperature between temperature $T_1$ and temperature $T_2$, and then cooled to a temperature below the room temperature $T_0$, the recording material assumes an intermediate state between the transparent state and the milky white opaque state.

When the recording material in the transparent state at room temperature $T_0$ is again heated to temperature $T_3$ or above, and then cooled to room temperature $T_0$, the recording material returns to the milky white opaque state. Thus, the reversible thermosensitive recording material according to the present invention can assume a milky white maximum opaque state, a maximum transparent state and an intermediate state between the aforementioned two states at room temperature.

Therefore, a milky white opaque image can be obtained on a transparent background, or a transparent image can also be obtained on a milky white opaque background by selectively applying the thermal energy to the reversible thermosensitive recording material according to the present invention. Further, such image formation and erasure can be repeated many times.

When a colored sheet is placed behind the reversible thermosensitive recording layer of the recording material, the colored image can be obtained on the white opaque background or the white opaque image can be obtained on the colored background.

In the case where the reversible thermosensitive recording material of the present invention is projected using an OHP (Over Head Projector), a milky white opaque portion in the recording material appears dark and a transparent portion in the recording material, through which the light passes becomes a bright portion on the screen.

To record the image on the reversible thermosensitive recording material of the present invention and erase it therefrom, two thermal heads, one is for the image formation and the other is for the image erasure may be used. Alternatively, a single thermal head is available if the conditions for applying the heat energy to the recording material can be changed depending on the recording operation and the erasing operation.

In the case where two thermal heeds are used, a device for applying the heat energy to the recording material is expensive, however, the image formation and erasure can easily be performed by once causing the recording material to pass through the two thermal heads from which the different heat energy is separately applied to the recording material corresponding to the image formation and image erasure. On the other hand, in the case where a single thermal head is used for both image formation and erasure, the cost of the above-mentioned device is low, but the operation becomes complicated. More specifically, it is necessary to delicately change the heat application conditions of the single thermal head corresponding to a portion where an image is to be recorded or erased while the recording material is caused to pass through the single thermal head at one operation. Or the images are erased by applying the thermal energy for image erasure to the recording material while the recording material is first caused to pass through the single thermal head. Then, when the recording material is caused to reversibly pass through the single thermal head, the images are recorded by the application of the thermal energy for image formation to the recording material.

To form the reversible thermosensitive recording layer on the support, (1) a solution in which both the matrix resin and the organic low-molecular-weight material are dissolved, or (2) a dispersion prepared by dispersing or reduction the organic low-molecular-weight material in a matrix resin solution by use of various methods may be coated on the support such as a film or a sheet, then dried, so that the reversible thermosensitive recording layer can be formed on the support. The aforementioned matrix resin dispersion of the low-molecular-weight material (2) employs a solvent in which only matrix resin can be dissolved.

The thermosensitive recording layer or the solvent used for the formation of the thermosensitive recording layer can be selected depending on the kind of the matrix resin and the type of the organic low-molecular-weight material to be employed. For example, the solvents such as tetrahydrofuran, methyl ethyl ketone, methyl isobutyl ketone, chloroform, carbon tetrachloride, ethanol, toluene and benzene can be employed. When not only the matrix resin dispersion (2), but also the solution (1) is used, the organic low-molecular-weight material in form of finely-divided particles can be dispersed in the matrix resin in the thermosensitive recording layer.

It is preferable that resins of the thermosensitive recording layer for use in the present invention have excellent film-forming or sheet-forming properties, high transparency and high mechanical stability.

Examples of such resins include polyvinyl chloride; vinyl chloride copolymers such as vinyl chloride—vinyl acetate copolymer, vinyl chloride— vinyl acetate—vinyl alcohol copolymer, vinyl chloride—vinyl acetate maleic acid copolymer, and vinyl—chloride—acrylate copolymer; vinylidene chloride copolymers such as polyvinylidene chloride, vinylidene chloride—vinyl chloride copolymer, vinylidene chloride—acrylonitrile copolymer, and vinyl chloride—acrylate copolymer; polyester; polyamide; polyacrylate, polymethacrylate or acrylate—methacrylate copolymer; and silicone resin. These resin components can be used alone or in combination.

On the other hand, the organic low-molecular-weight material for use in the reversible thermosensitive recording layer may be appropriately selected from the materials which are changeable from the polycrystalline state to the single crystalline state in accordance with each of the desired temperatures ranging from $T_1$ to $T_3$ as shown in FIG. 1. It is preferable that the organic low-molecular-weight material for use in the present invention have a melting point ranging from 30° to 200° C., more preferably from about 50° to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids; and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amines and ammonium salts thereof; and carboxylic acid esters of thioalcohol. These materials can be used alone or in combination.

It is preferable that the number of carbon atoms of the above-mentioned low-molecular-weight material be in the range of 10 to 60, more preferably in the range of 10 to 38, further preferably in the range of 10 to 30. Part of the alcohol groups in the esters may be saturated or unsaturated, and further may be substituted by halogen. In any case, it is preferable that the organic low-molecular-weight material have at least one atom selected from the group consisting of oxygen, nitrogen, sulfur and halogen in its molecule. More specifically, it is preferable the organic low-molecular-weight materials comprise, for instance, —OH, —COOH, —CONH, —COOR, —NH, —$NH_2$, —S—, —S—S—, —O—and a halogen atom.

Specific example of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid and oleic acid; esters of higher fatty acids such as methyl stearate, tetradecyl stearate, octadecyl stearate, octedecyl laurate, tetradecyl palmitate and dodecyl behenate; and the following ethers or thioethers:

$C_{16}H_{33}-O-C_{16}H_{33}$, $C_{16}H_{33}-S-C_{16}H_{33}$, $C_{18}H_{37}-S-C_{18}H_{37}$, $C_{12}H_{25}-S-C_{12}H_{25}$, $C_{19}H_{39}-S-C_{19}H_{39}$, $C_{12}H_{25}-S-S-C_{12}H_{25}$,

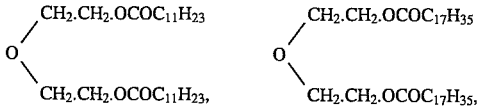

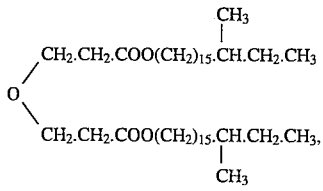

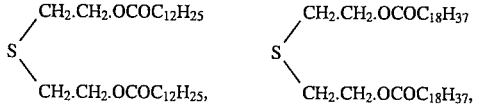

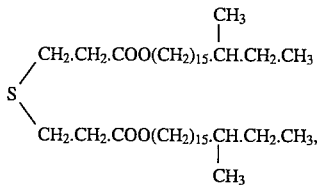

-continued

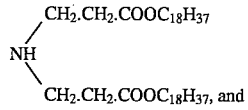

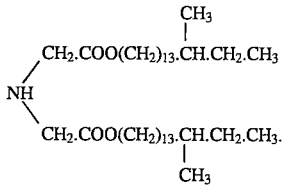

Of these, higher fatty acids having 16 or more carbon atoms, more preferably having 16 to 24 carbon atoms, such as palmitic acid, stearic acid, behenic acid and lignoceric acid are preferred in the present invention.

To widen the range of the temperature where the recording material can assume a transparent state, it is preferable to use the aforementioned organic low-molecular-weight materials in combination, or use the organic low-molecular-weight material in combination with the other material having a different melting point. Such materials having a different melting point are disclosed, for example, in Japanese Laid-Open Patent Applications 63-39378 and 63-130380, and Japanese Patent Publications 63-14754 and 1-140109.

It is preferable that the thickness of the reversible thermosensitive recording layer be in the range of 1 to 3 μm, more preferably in the range of 2 to 20 μm, in order to make the temperature distribution of the reversible thermosensitive recording layer uniform, and to obtain a uniform transparent state and a white opaque state with high contrast. The degree of the white opaqueness can be increased by increasing the amount of the organic low-molecular-weight material in the thermosensitive recording layer.

It is preferable that the ratio by weight of the organic low-molecular-weight material to the matrix resin be in the range of about (2:1) to (1:16), more preferably in the range of (1:1) to (1:3) in the reversible thermosensitive recording layer. When the ratio of the low-molecular-weight material to the matrix resin is within the above range, the matrix resin can form a film in which the organic low-molecular-weight material is uniformly dispersed in the form of finely-divided particles, and the obtained recording layer can readily reach the maximum white opaque state.

In the reversible thermosensitive recording layer for use in the present invention, additives such as a surface-active agent and a high-boiling point solvent can be employed to facilitate the formation of a transparent image. Examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethyl butyrate, methyl acetylricinoleate, butyl acetylricinoleate, butylphthalyl butyl glycolate and tributyl acetylcitrate.

Examples of the surface-active agent and the other additives are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, calcium, barium and magnesium salts of sulfuric monoester, phosphoric monoester and phosphoric diester; lower sulfated oil; long-chain polyalkyl acrylate; acrylic oligomer; long-chain polyalkyl methacrylate; long-chain alkyl methacrylate—amine-containing monomer copolymer; styrene—maleic anhydride copolymer; and olefin—maleic anhydride copolymer.

In the present invention, when the image formed on the reversible thermosensitive recording material is observed as a reflection type image, a light reflection layer may be formed behind the recording layer to improve the contrast of the image even if the thickness of the recording layer is made thin. Specifically, the light reflection layer can be prepared by deposition of aluminum, nickel and tin on the support as disclosed in Japanese Laid-Open Patent Application 64-14079.

Further, a protective layer can be formed on the reversible thermosensitive recording layer in order to prevent the surface of the thermosensitive recording layer from being deformed by the heat and pressure applied by a thermal head and from the transparency of the transparent portion thereof being decreased by such deformation. As the material for the protective layer, a silicone rubber and a silicone resin as disclosed in Japanese Laid-Open Patent Application 63-221087, a polysiloxane graft polymer as in Japanese Patent Publication 63-31785, an ultraviolet-curing resin or an electron radiation curing resin as in Japanese Patent Publication 2-566 can be employed. In any case, the material for the protective layer is dissolved in a solvent to prepare a coating liquid and the thus prepared coating liquid is coated on the thermosensitive recording layer. It is desirable that the resin and the organic low-molecular-weight material for use in the thermosensitive recording layer be not easily dissolved in such a solvent for use in the protective layer.

Examples of the above-mentioned solvent in which the resin and the organic low-molecular-weight material for use in the thermosensitive recording layer are not easily dissolved include n-hexane, methyl alcohol, ethyl alcohol and isopropyl alcohol. In particular, the alcohol-based solvents are preferred from the viewpoint of the cost.

It is preferable that the thickness of the protective layer be 0.1 to 5 μm.

Furthermore, as disclosed in Japanese Laid-Open patent Application 1-133781, an intermediate layer may be interposed between the protective layer and the thermosensitive recording layer to protect the thermosensitive recording layer from a solvent and a monomer component for use in the protective layer. As the material for the intermediate layer, besides the above-mentioned resins for use in the thermosensitive recording layer, the thermosetting resins and thermoplastic resins such as polyethylene, polypropylene, polystyrene, polyvinyl alcohol, polyvinyl butyral, polyurethane, saturated polyester, unsaturated polyester, epoxy resin, phenolic resin, polycarbonate and polyamide can be employed. The thickness of the intermediate layer is preferably about 0.1 to 2 μm to obtain an appropriate protection effect and not to reduce the thermosensitivity of the thermosensitive recording layer.

Other features of this invention will become apparent in the course of the following description of exemplary embodiments which are given for illustration of the invention and are not intended to be limiting thereof.

EXAMPLE 1

[Formation of Reversible Thermosensitive Recording Layer]

The following components were mixed to prepare a reversible thermosensitive recording layer coating liquid:

| | Parts by Weight |
|---|---|
| Behenic acid | 7 |
| Eicosandioic acid | 3 |
| Vinyl chloride-vinyl acetate copolymer (Trademark "VYHH", made by Union Carbide Japan K.K.) | 28 |
| Di-2-ethyl hexyl phthalate | 3 |
| Tetrahydrofuran | 128 |
| Toluene | 14 |

The thus obtained reversible thermosensitive recording layer coating liquid was coated on a support and heat was applied thereto by a heat-roll system under the following conditions, immediately after coating the coating liquid:

| | |
|---|---|
| Line speed | 6 m/min. |
| Temperature in Drying box | 120° C. |
| Temperature of the surface of the heat roll of the above drying apparatus | 90° C. |
| Contact time of the support and the heat-roll drying apparatus | 5 sec. |
| Coating system | Single nozzle coating system |
| Drying Time | 1 min. |
| Thickness of the thermosensitive recording layer | about 5 μm |

The above-mentioned coating and drying process was continued until a thermosensitive recording layer coated sheet with a length of more than 100 meters in the shape of a roll sheet was prepared.

[Formation of Intermediate Layer]

The following components were mixed to prepare an intermediate layer coating liquid:

| | Parts by Weight |
|---|---|
| Polyamide resin (Trademark "CM8000", made by Toray Industries Inc.) | 5 |
| Methanol | 95 |

The above prepared intermediate layer coating liquid was coated on the above-prepared reversible thermosensitive recording layer coated sheet by a wire bar and dried at 80° C. in a thermostatic chamber, so that an intermediate layer with a thickness of about 1 μm was formed on the reversible thermosensitive recording layer coated sheet.

[Formation of Protective Layer]

The following components were mixed to prepare a protective layer coating liquid:

| | Parts by Weight |
|---|---|
| Ultraviolet-curing resin (Trademark "Unidic C7-157" made by Dainippon Ink & Chemicals, Incorporated) | 10 |
| IPA | 10 |

The above prepared protective layer coating liquid was coated on the above-prepared intermediate layer of each reversible thermosensitive recording layer sheet by a wire bar, dried under the application of heat thereto, and exposed to the UV light of an ultraviolet lamp, so that a protective layer with a thickness of about 4 μm was formed on the intermediate layer. Thus, a reversible thermosensitive recording material No. 1 of the present invention was prepared.

EXAMPLE 2

The procedure for preparation of the reversible thermosensitive recording material No. 1 in Example 1 was repeated except that the heat-roll system employed in Example 1 for the formation of the thermosensitive recording layer coated sheet was replaced by a heat-plate drying apparatus, whereby a reversible thermosensitive recording material No. 2 of the present invention was prepared.

EXAMPLE 3

The procedure or preparation of the reversible thermosensitive recording layer No. 1 in Example 1 was repeated except that the heat-roll system employed in Example 1 for the formation of the thermosensitive recording layer coated sheet was replaced by a hot air drying apparatus, whereby a reversible thermosensitive recording material No. 3 of the present invention was prepared.

Comparative Example 1

The procedure for preparation of the reversible thermosensitive recording layer No. 1 in Example 1 was repeated except that none of heat-roll drying apparatus, heat-plate drying apparatus and hot air drying apparatus was employed, whereby a comparative reversible thermosensitive recording material No. 1 was prepared.

Comparative Example 2

The procedure for preparation of the reversible thermosensitive recording layer No. 1 in Example 1 was repeated except that the support was preheated, prior to the coating of the reversible thermosensitive recording layer coating liquid, by a heat-roll system under the same conditions as in Example 1, whereby a comparative recording material No. 2 was prepared.

Comparative Example 3

The procedure for preparation of the reversible thermosensitive recording material No. 1 in Example 1 was repeated except that the support was heated by the heat-roll drying apparatus simultaneously with the coating of the coating liquid for the reversible thermosensitive layer to the support, whereby a comparative reversible thermosensitive recording No. 3 was prepared.

The above prepared reversible thermosensitive recording materials No. 1 to No. 3 prepared in accordance with the method of the present invention and the comparative reversible thermosensitive recording materials No. 1 to No. 3 were evaluated with respect to the printing durability, the dust adhesion to a thermal head while in use, the deformation of the support while in use, the particle size of the fatty acid used as the organic low-molecular-weight material in the reversible thermosensitive recording layer.

In the above-mentioned evaluation, four samples of a 10 meter coating portion, a 50 meter coating portion, a 70 meter coating portion, and a 100 meter coating portion of the reversible thermosensitive recording layer from each of the reversible thermosensitive recording materials were employed for comparison.

In evaluating the printing durability, images were formed on each of the samples by using a printing test apparatus made by Yashiro Denki Co., Ltd. incorporating a thermal head made by Ricoh Company Ltd., under the conditions that the applied platen pressure was 3.0 kg/head, the applied pulse width was 1 ms and the applied electrical power was 25 V, and formed images were then erased using a heat roller heated to 80° C.

The formation of the images and erasure thereof were repeated 30 times and the printing durability was evaluated based on the difference between the image density at the 1st image formation and that at the 30th image formation with respect to each reversible thermosensitive recording material. The image density was measured by a Macbeth reflection-type densitometer (RD514).

Moreover, after 30-times repetition of the image formation and erasure, the dust adhesion to the thermal head was inspected and the thermal deformation of the support was visually inspected. The particle diameter of the fatty acid contained in each reversible thermosensitive recording layer was measured by using a photograph of a cross section of the reversible thermosensitive recording material.

The results are shown in Tables 1, 2, 3 and 4

TABLE 1

| | 10 Meter Coated | | | | | | | | |
|---|---|---|---|---|---|---|---|---|---|
| | Durability | | | | Adhesion | | Particle Size of Fatty Acid (μm) | | |
| | Reflected Density | | | | of Duct to | Deformation | | Near Surface of | |
| | 1st printing | 30th printing | Difference | Evaluation Judgement | to Thermal Head | of Support | Near Support | Recording Layer | Profile |
| Ex. 1 | 0.75 | 0.82 | 0.07 | o - Δ | Slight | None | 4.0 | 1.0 | $T_1 < T_2$ |
| Ex. 2 | 0.73 | 0.76 | 0.03 | o | None | Slight | 2.0 | 0.5 | $T_1 < T_2$ |
| Ex. 3 | 0.74 | 0.78 | 0.04 | o | None | None | 2.7 | 0.6 | $T_1 < T_2$ |
| Comp. Ex. 1 | 0.89 | 1.42 | 0.53 | x | Excessive | None | 8.0 | 3.0 | $T_1 < T_2$ |

TABLE 1-continued

| | 10 Meter Coated | | | | | | | | |
|---|---|---|---|---|---|---|---|---|---|
| | Durability | | | | Adhesion | | Particle Size of Fatty Acid (μm) | | |
| | Reflected Density | | | | of Duct to | Deformation | | Near Surface of | |
| | 1st printing | 30th printing | Difference | Evaluation Judgement | to Thermal Head | of Support | Near Support | Recording Layer | Profile |
| Comp. Ex. 2 | 0.80 | 0.93 | 0.13 | Δ | Much | None | 4.8 | 2.0 | $T_1 < T_2$ |
| Comp. Ex. 3 | 0.73 | 0.76 | 0.03 | ○ | None | None | 2.5 | 0.6 | $T_1 < T_2$ |

*The printing durability was evaluated by the difference between the reflected image density at the 1st printing and that at the 30th printing and the marks, ○, ○ - Δ, and X, respectively denote as follows:
○: The difference is 0.06 or less.
○ - Δ: The difference is in the range of 0.06 to 0.10.
X: The difference is 0.31 or more.

TABLE 2

| | 50 Meter Coated Samples | | | | | | |
|---|---|---|---|---|---|---|---|
| | Durability | | | | | Particle Size of Fatty Acid (μm) | |
| | Reflected Density | | | | Adhesion | | Near Surface |
| | 1st printing | 30th printing | Difference | Evaluation Judgement | of Duct to Thermal Head | Near Support | of Recording Layer |
| Ex. 1 | 0.77 | 0.83 | 0.06 | ○ - Δ | Slight | 3.9 | 1.1 |
| Ex. 2 | 0.72 | 0.74 | 0.02 | ○ | None | 1.8 | 0.6 |
| Ex. 3 | 0.73 | 0.76 | 0.03 | ○ | None | 2.3 | 0.7 |
| Comp. Ex. 1 | 0.86 | 1.32 | 0.46 | X | Excessive | 7.0 | 3.2 |
| Comp. Ex. 2 | 0.79 | 0.92 | 0.13 | Δ | Much | 4.7 | 2.2 |
| Comp. Ex. 3 | 0.78 | 0.85 | 0.09 | ○ - Δ | Slight | 4.0 | 1.2 |

*The printing durability was evaluated by the difference between the reflected image density at the 1st printing and that at the 30th printing and the marks, ○, ○ - Δ, and X, respectively denote as follows:
○: The difference is 0.06 or less.
○ - Δ: The difference is in the range of 0.06 to 0.10.
X: The difference is 0.31 or more.

TABLE 3

| | 70 Meter Coated Samples | | | | | | |
|---|---|---|---|---|---|---|---|
| | Durability | | | | | Particle Size of Fatty Acid (μm) | |
| | Reflected Density | | | | Adhesion | | Near Surface |
| | 1st printing | 30th printing | Difference | Evaluation Judgement | of Duct to Thermal Head | Near Support | of Recording Layer |
| Ex. 1 | 0.74 | 0.80 | 0.06 | ○ - Δ | Slight | 3.8 | 1.3 |
| Ex. 2 | 0.71 | 0.75 | 0.04 | ○ | None | 1.9 | 0.8 |
| Ex. 3 | 0.73 | 0.76 | 0.03 | ○ | None | 2.3 | 0.8 |
| Comp. Ex. 1 | 0.89 | 1.40 | 0.51 | X | Excessive | 7.8 | 3.2 |
| Comp. Ex. 2 | 0.83 | 1.01 | 0.18 | Δ | Much | 4.8 | 2.3 |
| Comp. Ex. 3 | 0.80 | 0.94 | 0.14 | Δ | Much | 4.5 | 1.9 |

TABLE 3-continued

| | 70 Meter Coated Samples | | | | | | |
|---|---|---|---|---|---|---|---|
| | Durability | | | | | Particle Size of Fatty Acid (μm) | |
| | Reflected Density | | | | Adhesion | | Near Surface |
| | 1st printing | 30th printing | Difference | Evaluation Judgement | of Duct to Thermal Head | Near Support | of Recording Layer |

*The printing durability was evaluated by the difference between the reflected image density at the 1st printing and that at the 30th printing and the marks, o, o - Δ, and X, respectively denote as follows:
o: The difference is 0.06 or less.
o - Δ: The difference is in the range of 0.06 to 0.10.
X: The difference is 0.31 or more.

TABLE 4

| | 100 Meter Coated Samples | | | | | | |
|---|---|---|---|---|---|---|---|
| | Durability | | | | | Particle Size of Fatty Acid (μm) | |
| | Reflected Density | | | | Adhesion | | Near Surface |
| | 1st printing | 30th printing | Difference | Evaluation Judgement | of Duct to Thermal Head | Near Support | of Recording Layer |
| Ex. 1 | 0.74 | 0.81 | 0.07 | o - Δ | Slight | 3.9 | 0.8 |
| Ex. 2 | 0.74 | 0.76 | 0.02 | o | None | 2.0 | 0.5 |
| Ex. 3 | 0.74 | 0.79 | 0.05 | o | None | 2.5 | 0.6 |
| Comp. Ex. 1 | 0.87 | 1.37 | 0.50 | X | Excessive | 7.5 | 3.0 |
| Comp. Ex. 2 | 0.79 | 0.93 | 0.12 | Δ | Much | 4.5 | 2.1 |
| Comp. Ex. 3 | 0.87 | 1.32 | 0.45 | X | Excessive | 7.0 | 2.8 |

*The printing durability was evaluated by the difference between the reflected image density at the 1st printing and that at the 30th printing and the marks, o, o - Δ, and X, respectively denote as follows:
o: The difference is 0.06 or less.
o - Δ: The difference is in the range of 0.06 to 0.10.
X: The difference is 0.31 or more.

What is claimed is:

1. A method of producing a reversible thermosensitive recording material comprising a support, and a reversible thermosensitive recording layer formed on said support, said reversible thermosensitive recording layer comprising a matrix resin and an organic low-molecular-weight material dispersed in said matrix resin, and capable of reversibly assuming a transparent state and a white opaque state depending upon the temperature thereof, comprising the steps of:

applying a solution or dispersion of said matrix resin and said organic low-molecular-weight material dissolved or dispersed in a solvent to said support, and drying said applied solution or dispersion with the application of heat thereto in such a manner that when the temperature of said solution or dispersion applied side of said support is $t_1$, and the temperature of the back side surface of said support, opposite to said solution or dispersion applied side thereof, is $t_2$, $t_1$ is lower than $t_2$, that is, $t_1<t_2$, with the back side surface of said support being heated immediately after the application of said solution or dispersion, wherein said reversible thermosensitive recording material produced has a length of 50 meters or more.

2. The method of producing a reversible thermosensitive recording material as claimed in claim 1, wherein said application of heat for drying said solution or dispersion is carried out by at least one heating apparatus selected from the group consisting of a heat-roll drying apparatus, a hot air drying apparatus, and a heat-plate drying apparatus.

3. The method of producing a reversible thermosensitive recording material as claimed in claim 1, wherein said application of heat for drying said solution or dispersion is carried out by a heat-back-roller drying apparatus.

* * * * *